United States Patent [19]

Okamoto et al.

[11] Patent Number: 4,486,762

[45] Date of Patent: Dec. 4, 1984

[54] SELF-CONTAINED TYPE PRESSURE SENSITIVE RECORD SHEET

[75] Inventors: Shigeo Okamoto, Suita; Tomoharu Shiozaki, Amagasaki, both of Japan

[73] Assignee: Kanzaki Paper Manufacturing Co., Ltd., Tokyo, Japan

[21] Appl. No.: 439,626

[22] Filed: Nov. 4, 1982

[30] Foreign Application Priority Data

Nov. 30, 1981 [JP] Japan ..... 56-193104

[51] Int. Cl.[3] ..... B41M 5/16

[52] U.S. Cl. ..... 346/207; 346/226; 428/326

[58] Field of Search ..... 282/27.5; 427/150, 151; 428/326, 320.8, 411, 537, 914

[56] References Cited

U.S. PATENT DOCUMENTS 2,711,375 6/1955 Sandberg ..... 428/321.5

FOREIGN PATENT DOCUMENTS 1232347 5/1971 United Kingdom ..... 282/27.5

*Primary Examiner*—Bruce H. Hess

*Attorney, Agent, or Firm*—Armstrong, Nikaido, Marmelstein & Kubovcik

[57] ABSTRACT

A self-contained type pressure sensitive record sheet prepared by coating a substrate with a mixture of a color acceptor and microcapsules containing a color former in the form of a single layer and drying the resulting coating, the mixture containing 40 to 200 parts by weight, per 100 parts by weight of the microcapsules calculated as solids, of a pulp powder having a weight average fiber length of 20 to 80μ, has well-balanced improved properties in respect of color forming ability, prevention of color smudging and printability.

2 Claims, No Drawings

SELF-CONTAINED TYPE PRESSURE SENSITIVE RECORD SHEET

The present invention relates to a self-contained type pressure sensitive record sheet which is coated with a mixture of an encapsulated color former and a color acceptor in the form of a single layer and which is made less susceptible to color smudges due to contact or friction although having high color forming ability, the record sheet further having improved printability.

The self-contained type pressure sensitive record sheet is one type of pressure sensitive manifold paper wherein the color forming reaction is used between an electron donating chromogenic material (hereinafter referred to as "color former") and an electron accepting reactant material (hereinafter referred to as "color acceptor"). The record sheet is formed by coating a substrate with a layer of microcapsules enclosing oily droplets having a color former dissolved or dispersed therein and with another layer of a color acceptor (usually with the color acceptor layer formed over the microcapsule layer), or by coating a substrate with a mixture of such microcapsules and color acceptor in the form of a single layer.

Like usual pressure sensitive manifold paper, such self-contained type pressure sensitive record sheets have the drawback that microcapsules rupture to produce color smudges when subjected to a contact, friction or like external pressure. To remedy the drawback in the case of usual manifold paper, a stilt material, such as pulp, starch or polyolefin material, in the form of particles larger than the microcapsules is dispersed into the microcapsule coating layer so that the projections of the stilt material will withstand contact or friction to reduce the breakdown of capsules. However, starch particles and polyolefin particles have the problem that the amount thereof used has a close relation with the color forming ability such that if used in an increased amount, the material impairs the color forming ability. Since pulp powders have a lesser relation between the amount and the color forming ability than starch and polyolefin particles, pulp powder has long been used generally as a stilt material. The pulp powder is used usually in an amount of about 20 to about 30 parts by weight per 100 parts by weight of microcapsules. If used in a larger amount, the pulp powder seriously impairs the flowability of the coating composition to reduce the applicability of the composition to the substrate and further renders the resulting coating rough-surfaced and less amenable to printing and copying.

While it is similarly necessary for self-contained type pressure sensitive record sheets to be free of color smudges due to contact or friction, these sheets are more susceptible to color smudges than the usual pressure sensitive manifold paper because of the structure thereof. Moreover self-contained type pressure sensitive record sheets of the single layer type are more prone to color smudges than those of the multi-layer type.

Self-contained type pressure sensitive record sheets of the single layer type nevertheless have advantages. They require only one coating step and are less costly to manufacture. Because the microcapsules and the color acceptor are present in mixture in close proximity, they produce satisfactory records even at a low pressure, thus exhibiting higher color forming ability. Ideally, therefore, it is desirable to provide record sheets of the single layer type having reduced susceptibility to color smudges. However, the record sheets commercially available at present are predominantly of the multi-layer type, and those of the single layer type are only in small quantitites.

The record sheets of the latter type which are commercially available are limited in amenability to recording and are thereby made less susceptible to color smudges. Thus they still remain to be greatly improved in quality and commercial value.

An object of the present invention is to provide self-contained type pressure sensitive record sheets of the single layer type having reduced susceptibility to color smudges and yet outstanding in amenability to recording and printing.

Another object of the invention is to provide self-contained type pressure sensitive record sheets of the single layer type which are prepared with use of a coating composition having good flowability and high applicability to substrates.

Stated more specifically, the present invention provide a self-contained type pressure sensitive record sheet prepared by coating a substrate with a mixture of a color acceptor and microcapsules containing a color former in the form of a single layer and drying the resulting coating, the mixture containing 40 to 200 parts by weight, per 100 parts by weight of the microcapsules calculated as solids, of a pulp powder having a weight average fiber length (TAPPI standard T232, SU-68) of 20 to 80$\mu$.

The pulp powder to be incorporated into the mixture must be 20 to 80$\mu$ in weight average fiber length because if it is more than 80$\mu$, the coating becomes rough-surfaced and exhibits reduced printability, whereas if it is less than 20$\mu$, the coating still remains susceptible to color smudges. Incidentally the pulp powder heretofore used for the usual pressure sensitive manifold paper is intended chiefly to prevent color smudging and is therefore generally about 85 to about 100$\mu$ in weight average fiber length to achieve a great stilt effect. This is attributable to the fact that much consideration has not been given, and indeed need not be given, to the printability of the usual pressure sensitive manifold paper since the microcapsule coating surface is rarely printed. On the other hand, self-contained type pressure sensitive record sheets are used usually with some printing on the record layer (coating layer), so that if the pulp powder used has such a larger fiber length, the layer becomes rough-surfaced to exhibit impaired printability, rendering the sheet unsatisfactory to use in quality.

The present invention is characterized in that a pulp powder having a weight average fiber length of 20 to 80$\mu$ is used in an amount of 40 to 200 parts be weight, preferably 50 to 100 parts by weight, per 100 parts by weight of the microcapsules. This feature is in close relation with the fact that the record layer is in the form of a single layer.

Self-contained type pressure sensitive record sheets of the single layer type contain microcapsules and a color acceptor in mixture in close proximity with each other and accordingly have outstanding amenability to recording but are highly susceptible to color smudging due to contact or friction. In order to obtain record sheets of this type having good amenability to recording in balance with prevention of color smudging, we have found by experiments that it is critical to use the pulp powder in the above amount. Whereas about 20 to about 30 parts by weight of pulp powder is used per 100 parts by weight of microcapsules for conventional pressure sensitive manifold paper having a balance between amenability to copying and prevention of color smudging, the foregoing amount is much larger than is usually used and well beyond the amounts that are generally thought to be appropriate for stilt materials.

In this sense, the pulp fiber length and the amount defined in the appended claim are the essential requirements for providing self-contained type pressure sensitive record sheets of the single layer type which are commercially valuable in quality.

Insofar as the pulp powder to be used in this invention is 20 to 80μ in weight average fiber length, the pulp powder can be of any kind, such as one prepared by acid hydrolysis followed by mechanical pulverization or one prepared merely by mechanically pulverizing a pulp.

The color former to be used in this invention for preparing the contemplated record sheets can be any of various dyes. Examples of useful dyes are:

Triarylmethane-based dyes, e.g., 3,3-bis(p-dimethylaminophenyl)-6-dimethylaminophthalide (hereinafter referred to as "crystal violet lactone"), 3,3-bis(p-dimethylaminophenyl)phthalide, 3-(p-dimethylaminophenyl)-3-(1,2-dimethylindole-3-yl)phthalide, 3-(p-dimethylaminophenyl) -3-(2-methylindole-3-yl)phthalide, 3-(p-dimethylaminophenyl)-3-(2-phenylindole-3-yl)phthalide, 3,3-bis(1,2-dimethyindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and N-butyl-3-[bis{4-(N-methylanilino)phenyl}methyl]carbazole;

Diphenylmethane-based dyes e.g., 4,4'-bis-dimethylaminobenzhydryl benzyl ether, N-halophenylleucoauramine and N-2,4,5-trichlorophenyl-leucoauramine;

Lactam-based dyes, e.g., rhodamine-B-anilinolactam, rhodamine-(p-nitroanilino)lactam and rhodamine(o-chloroanilino)lactam;

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-diethylamino-7-(N-acetyl-N-methylamino)fluoran, 3-diethylamino-7-methylaminofluoran, 3,7-diethylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-diethylaminofluoran, 3-(N-ethyl-p-toluidino)-7-(N-methylanilino)fluoran, 3-(N-ethyl-p-toluidino)-7-methylfluoran, 3-diethylaminobenz(C)fluoran, 2-mesidino-8-diethylaminobenz(C)fluoran, 3-diethylamino-5-methyl-7-dibenzylaminofluoran, 3-chloro-6-cyclohexylaminofluoran, 3-diethylamino-7-cyclohexylaminofluoran, 3-diethylamino-7-(N-cyclohexyl-N-benzylamino)fluoran, 3-(N-ethyl-p-toluidino)-6-methyl-7-anilinofluoran, 3-(N-ethyl-p-toluidino)-6-methyl-7-p-toluidinofluoran and 3-(N-cyclohexyl-N-methylamino) 6-methyl-7-anilinofluoran;

Thiazine-based dyes, e.g., benzoyl-leucomethyleneblue and p-nitrobenzoyl-leucomethyleneblue;

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho(6'-methoxybenzo)spiropyran and 3-propyl-spiro-dibenzopyran.

According to the invention, the color former is dissolved or dispersed in various nonvolatile organic solvents which are not particularly limited. At least one of organic solvents which are usually used for microcapsules for pressure sensitive manifold papers is usable. Examples of solvents generally useful are petroleum, kerosene, xylene, toluene and like mineral oils, and hydrogenated terphenyl, alkylnapthalene, alkylated diphenylalkane, alkylated triphenylethane, alkylated diphenyl and like aromatic hydrocarbons. Aliphatic hydrocarbons, alcohols, ketones and esters are also usable as admixed with such solvents.

To the oily solution dissolved or dispersed the color former therein can be added optionally auxiliary agents such as a ultraviolet absorbent, etc. The oily solution containing the color former is microencapsulated by various methods stated below to afford a microcapsule dispersion containing the color former.

Microcapsules containing the color former are prepared by various suitable processes which are useful for producing pressure sensitive record sheets, such as complex coacervation processes, simple coacervation processes, in-situ polymerization processes and interfacial polymerization processes.

The coacervation processes include those using two components, such as gelatin and gum arabic, or gelatin and carboxymethyl cellulose, those using three components, such as gelatin, carboxymethyl cellulose and methyl vinyl ether-maleic anhydride copolymer, and microcapsulation process wherein polyvinyl alcohol having a cloud point is used, or like simple coacervation process.

Urea-formaldehyde resin, or melamine-formaldehyde resin, for example, are used for in-situ polymerization processes. Interfacial polymerization processes use, for example, acid chloride and amine, isocyanate and water, isocyanate and polyamine, isocyanate and polyol, isothiocyanate and water, isothiocyanate and polyamine, and isothiocyanate and polyol.

Examples of useful polyisocyanate compounds are triphenyldimethylene triisocyanate, tetraphenyltrimethylene tetraisocyanate, pentaphenyltetramethylene pentaisocyanate, tolylene diisocyanate, xylylene diisocyanate and like aromatic polyisocyanate, trimethylene diisocyanate, hexamethylene diisocyanate, propylene-1,2-diisocyanate, butylene-1,2-diisocyanate, ethylidene diisocyanate, polyisocyanate prepolymers which are addition products of these isocyanates with polyhydroxy compounds, polyamines, polycarboxylic acids, polythiols or epoxy compounds, and trimers of aliphatic polyisocyanates such as ethylene diisocyanate, decamethylene diisocyanate, lysine diisocyanate, trimethylhexamethylene diisocyanate and hexamethylene diisocyanate, the trimers being represented by the structural formula

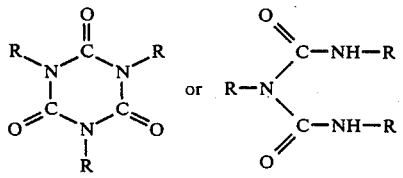

wherein R is an aliphatic group having at least one isocyanate group. Aliphatic polyisocyanates, such as 4-isocyanatomethyl-1,8-octamethylene diisocyanate, are also useful.

Useful polyamines are any of those which have at least two —NH or —$NH_2$ groups in the molecule and which are soluble or dispersible in hydrophilic liquids forming a continuous phase. Examples of useful polyamines are aliphatic polyamines such as diethylenetriamine, triethylenetetramine, 1,3-propylenediamine and hexamethylenediamine; adducts of aliphatic polyamines and epoxy compounds; alicyclic polyamines such as piperazine; and heterocyclic diamines such as 3,9-bis-aminopropyl-2,4,8,10-tetraoxaspiro-[5,5]-undecane.

Examples of color acceptors useful for the invention are inorganic color acceptors, such as acid clay, activated clay, bentonite, attapulgite and silica gel, and organic color acceptors, such as polyvalent metal salts of aromatic carboxylic acids and phenol polymers. Such color acceptors are generally dispersed in water and optionally pulverized by ball mill, sand mill and the like, and thus color acceptor dispersions are obtained.

The coating composition of the self-contained type pressure sensitive record sheet of the single layer type of the invention can generally be prepared by admixing the dispersion of microcapsules containing the color former, color acceptor dispersion, pulp powder having a specified weight average fiber length, adhesive and auxiliary agents.

Examples of useful adhesives are starches, carboxymethyl cellulose and like water-soluble natural high molecular weight compounds; polyvinyl alcohol, polyacrylic acid and like water-soluble synthetic high molecular weight compounds; styrene-butadiene copolymer latex, acrylic ester latex, vinyl acetate latex and like latexes.

Examples of useful auxiliary agents are white-color pigments such as oxide, hydroxide, carbonate, silicate, sulfate and halide of aluminum, zinc, magnesium, calcium and titanium and like metal compounds, kaolin, talc, clay and like clay minerals; surfactants; coloring dyes; fluorescent dyes; ultraviolet absorbent; etc.

The coating composition is applied to a substrate by any means, such as air knife coater, roll coater, gravure coater, blade coater or the like, or by various printing methods.

Examples of preferred substrates are paper, synthetic paper and synthetic film.

The present invention will be described in greater detail with reference to the following examples, to which the invention is not limited. The parts and percentages in the examples are all by weight.

EXAMPLE 1

(1) Preparation of dispersion of microcapsules containing color former

Three parts of crystal violet lactone was dissolved in 100 parts of diisopropylnaphthalene. Further dissolved in the oily solution were 4 parts of an aromatic polyisocyanate, namely, polymethylenepolyphenyl isocyanate (trade name "MILLIONATE MR500," product of Nihon Polyurethane Co. Ltd.) and 8 parts of trimer of an aliphatic polyisocyanate, namely, hexamethylene diisocyanate having a biuret bond (the trimer being a product of Nihon Polyurethane Co., Ltd., with the trade name of "CORONATE N"). The resulting oily solution was emulsified with 200 parts of 4% aqueous solution of polyvinylbenzenesulfonic acid partly converted to sodium salt (trade name "VERSA-TL500," product of National Starch & Chemical Corp.) using a homomixer to obtain a dispersion of particles 9μ in mean size. One part of diethylenetriamine and 0.2 part of hexamethylenediamine were added to the dispersion. The mixture was stirred at room temperature for 15 minutes, thereafter reacted at an elevated temperature of 80° C. for 4 hours and subsequently cooled to room temperature to prepare a dispersion of microcapsules containing the color former.

(2) Preparation of dispersion of color acceptor

Activated clay (100 parts) and 4 parts of sodium hydroxide were thoroughly dispersed in 400 parts of water. To the dispersion was added 20 parts of styrene-butadiene copolymer latex (50% solids) to obtain a dispersion of the color acceptor.

(3) Preparation of self-contained type pressure sensitive record sheet of the single layer type The microcapsule dispersion (50 parts, calculated as solids), 100 parts (calculated as solids) of the color acceptor dispersion and 50 parts of a pulp powder 56μ in weight average fiber length were mixed together to obtain a uniform coating composition. The composition was smoothly flowable even at a concentration of 35% and had no problem in respect of its liquid properties. The composition was applied in the form of a single layer to a substrate in an amount of 10 g/$m^2$ by air knife coating to obtain a self-contained type pressure sensitive record sheet.

EXAMPLE 2

(1) Preparation of dispersion of microcapsules containing color former

One hundred parts of 3% aqueous solution of ethylene-maleic anhydride copolymer, 10 parts of urea and 1 part of resorcin were dissolved in 200 parts of water, and the solution was adjusted to a pH of 3.3 with 20% aqueous solution of sodium hydroxide. A solution of 3 parts of crystal violet lactone in 100 parts of diisopropylnaphthalene naphthalene was added to the above solution, and the mixture was treated with use of a homomixer for emulsification to prepare a dispersion of particles 4.6μ in mean size. Twenty-five parts of 37% aqueous solution of formaldehyde was added to the dispersion. The mixture was heated to 55° C. with stirring, maintained at this temperature for 2 hours and thereafter cooled to obtain a capsule dispersion.

(2) Preparation of dispersion of color acceptor

Sixty parts of styrene polymer having a melting point of 121° C. was heated to 180° C. for melting, and 100 parts of zinc salt of 3,5-di(α-methylbenzyl)salicylic acid was mixed with and dissolved in the melt. The resulting melt was solidified by cooling, and the solid mass was crushed to obtain coarse particles of color acceptor. The color acceptor was dispersed in 500 parts of water containing 1 part of sodium butylnaphthalenesulfonate (trade name "PELEX NBL," product of Kao Atlas Co., Ltd.) and 25 parts of 10% aqueous solution of polyvinyl alcohol (trade name "PVA-117," product of Kuraray Co., Ltd.). The dispersion was treated by a continuous sand mill to obtain fine particles of color acceptor 3.4μ in mean size.

To the dispersion were added 40 parts of finely divided zinc silicate, 100 parts of kaolin, 200 parts of 10% aqueous solution of oxidized starch and 200 parts of water. After thoroughly stirring the mixture, 50 parts of styrene-butadiene copolymer latex (50% solids) was admixed therewith with stirring to obtain a dispersion of color acceptor.

(3) Preparation of self-contained type pressure sensitive record sheet of the single layer type The microcapsule dispersion (100 parts, calculated as solids), 100 parts (calculated as solids) of the color acceptor dispersion and 80 parts of a pulp powder 72μ in weight average fiber length were mixed together to obtain a uniform coating composition. The composition was smoothly flowable even at a concentration of 35% and had no problem in its liquid properties. A self-contained type pressure sensitive record sheet of the single layer type was prepared in the same manner as in Example 1 with use of the composition.

EXAMPLE 3

(1) Preparation of dispersion of microcapsules containing color former

Three parts of crystal violet lactone was dissolved in 100 parts of diisopropylnaphthalene, and the solution was dispersed in 400 parts of 5% aqueous solution of acid-treated gelatin at 55° C. for emulsification. To the emulsion was added 400 parts of 5% aqueous solution of gum arabic. While maintaining the mixture at 55° C., the mixture was adjusted to a pH of 4.0 by adding 5% aqueous solution of acetic acid thereto dropwise and was cooled to 10° C. with continued stirring. Subsequently 20 parts of 10% aqueous solution of formaldehyde was added to the mixture. The resulting mixture was adjusted to a pH of 10.0 with 10% aqueous solution of sodium hydroxide and thereafter stirred for 10 hours to obtain a capsule dispersion.

(2) Preparation of dispersion of color acceptor

A color acceptor dispersion was prepared in the same manner as in Example 2.

(3) Preparation of self-contained type pressure sensitive record sheet of the single layer type The capsule dispersion (100 parts, calculated as solids), 150 parts (calculated as solids) of the color acceptor dispersion and 100 parts of a pulp powder 35μ in weight average fiber length were mixed together to obtain a uniform coating composition.

The composition was smoothly flowable even at a concentration of 35% and had no problem in respect of its liquid properties. A self-contained type pressure sensitive record sheet of the single layer type was prepared in the same manner as in Example 1 with use of the composition.

EXAMPLE 4

(1) Preparation of dispersion of microcapsules containing color former

Three parts of crystal violet lactone was dissolved in 100 parts of diisopropylnaphthalene. In the oily solution were dissolved 4 parts of polymethylenepolyphenyl isocyanate ("MILLIONATE MR500") and 10 parts of trimer of hexamethylene diisocyanate having an isocyanurate ring (trade name "CORONATE EH," product of Nihon Polyurethane Co., Ltd.).

The resulting solution was added to 300 parts of 5% aqueous solution of polyvinyl alcohol ("PVA-177"), and the mixture was treated by a homomixer for emulsification to obtain a dispersion of particles 11μ in mean size. To the dispersion was added 2 parts of a polyfunctional addition product of 2,2-bis(4'-hydroxyphenyl)-propane, epichlorohydrin and alkylamine. The mixture was stirred at room temperature for 15 minutes, then reacted at an elevated temperature of 90° C. for 4 hours and thereafter cooled to room temperature to obtain a dispersion of microcapsules containing the color former.

(2) Preparation of dispersion of color acceptor

A color acceptor dispersion was prepared in the same manner as in Example 1.

(3) Preparation of self-contained type pressure sensitive record sheet of the single layer type The capsule dispersion (100 parts, calculated as solids), 200 parts (calculated as solids) of the color acceptor dispersion and 100 parts of a pulp powder 49μ in weight average fiber length were mixed together to obtain a uniform coating composition.

The composition was smoothly flowable even at a concentration of 35% and had no problem in respect of its liquid properties. A self-contained type pressure sensitive record sheet of the single layer type was prepared in the same manner as in Example 1 with use of the composition.

EXAMPLE 5

(1) Preparation of dispersion of microcapsules containing color former

Three parts of crystal violet lactone was dissolved in 100 parts of diisopropylnaphthalene. In the oily solution were dissolved 3 parts of polymethylenepolyphenyl isocyanate ("MILLIONATE MR500") and 5 parts of trimer of hexamethylene diisocyanate having a biuret bond ("CORONATE N").

The resulting oil solution was emulsified with 150 parts of an aqueous solution containing 2 parts of a homopolymer of 2-acrylamido-2-methylpropanesulfonic acid (MW=2,000,000) and 2 parts of polyvinyl pyrrolidone (trade name "LUVISKOL K-30," product of BASF A.G.), the aqueous solution being adjusted to a pH of 7.0 with use of sodium hydroxide, using a homomixer to obtain a dispersion of particles 10μ in mean size. The dispersion was heated at an elevated temperature of 90° C. for 5 hours with stirring and subsequently cooled to room temperature to obtain a dispersion of microcapsules containing the color former.

(2) Preparation of dispersion of color acceptor

A color acceptor dispersion was prepared in the same manner as in Example 1.

(3) Preparation of self-contained type pressure sensitive record sheet of the single layer type The capsule dispersion (100 parts, calculated as solids), 200 parts (calculated as solids) of the color acceptor dispersion and 150 parts of a pulp powder 35μ in weight average fiber length were mixed together to obtain a uniform coating composition.

The composition was smoothly flowable even at a concentration of 35% and had no problem in respect of its liquid properties. A self-contained type pressure sensitive record sheet of the single layer type was prepared in the same manner as in Example 1 with use of the composition.

EXAMPLE 6

(1) Preparation of dispersion of microcapsules containing color former

Three parts of crystal violet lactone was dissolved in a solvent mixture of 90 parts of diisopropylnaphthalene and 10 parts of dimethyl phthalate. In the oily solution were dissolved 25 parts of an adduct of tolylene diisocyanate and trimethylol propane (trade name "CORONATE L," product of Nihon Polyurethane Co., Ltd.).

The resulting solution was added 200 parts of 5% aqueous solution of polyvinyl alcohol ("PVA-117"), and the mixture was treated by a homomixer for emulsification to obtain a dispersion of particles 10μ in mean size. The dispersion was heated at an elevated temperature of 80° C. for 4 hours with stirring and subsequently cooled to room temperature to obtain a dispersion of microcapsules containing the color former.

(2) Preparation of dispersion of color acceptor

Activated clay (100 parts), 4 parts of sodium hydroxide and 20 parts of 2,2-bis(4'-hydroxyphenyl)propane were thoroughly dispersed in 400 parts of water. To the disperson was added 20 parts of styrene-butadiene copolymer latex (50% solids) to obtain a dispersion of the color acceptor.

(3) Preparation of self-contained type pressure sensitive record sheet of the single layer type The microcapsule dispersion (100 parts, calculated as solids), 100 parts (calculated as solids) of the color acceptor dispersion and 50 parts of a pulp powder 72μ in weight average fiber length were mixed together to obtain a uniform coating composition.

The composition was smoothly flowable even at a concentration of 35% and had no problem in respect of its liquid properties. A self-contained type pressure sensitive record sheet of the single layer type was prepared in the same manner as in Example 1 with use of the composition.

COMPARISON EXAMPLE 1

A self-contained type pressure sensitive record sheet of the single layer type was prepared in the same manner as in Example 1 with the exception of not using the pulp powder used in Example 1.

COMPARISON EXAMPLE 2

A self-contained type pressure sensitive record sheet of the single layer type was prepared in the same manner as in Example 2 except that starch particles were used in place of the pulp powder used in Example 2.

COMPARISON EXAMPLE 3

A self-contained type pressure sensitive record sheet of the single layer type was prepared in the same manner as in Example 3except that a pulp powder 85μ in weight average fiber length was used in place of the pulp powder used in Example 3.

COMPARISON EXAMPLE 4

A self-contained type pressure sensitive record sheet of the single layer type was prepared in the same manner as in Example 4 except that a pulp powder 92μ in weight average fiber length was used in place of the pulp powder used in Example 4.

COMPARISON EXAMPLE 5

A coating composition was prepared in the same manner as in Example 4 except that the pulp powder was used in an amount of 220 parts. At a concentration of 35%, the composition exhibited very poor flowability and was not applicable to a substrate uniformly.

COMPARISON EXAMPLE 6

A self-contained type pressure sensitive record sheet of the single layer type was prepared in the same manner as in Example 2 except that the pulp powder was used in an amount of 30 parts.

The twelve record sheets thus prepared were tested for quality. Table 1 shows the results.

TABLE 1

| | Record density | Press smudge | Friction smudge | Ink transferability |
|---|---|---|---|---|
| EX. 1 | 0.71 | 0.12 | A | O |
| EX. 2 | 0.72 | 0.10 | A | O |
| EX. 3 | 0.69 | 0.10 | A | O |
| EX. 4 | 0.70 | 0.11 | A | O |
| EX. 5 | 0.65 | 0.09 | A | O |
| EX. 6 | 0.74 | 0.13 | A | O |
| Com. EX. 1 | 0.91 | 0.20 | B | O |
| Com. EX. 2 | 0.43 | 0.09 | A | O |
| Com. EX. 3 | 0.65 | 0.10 | A | X |
| Com. EX. 4 | 0.58 | 0.09 | A | X |
| Com. EX. 5 | Impossible to coat uniformly | | | |
| Com. EX. 6 | 0.82 | 0.16 | B | O |

Note:

RECORD DENSITY

The sheet was struck with a 2 mm square flat-faced type at a high pressure using a typewriter (HERMES-700EL). The density of color formed was measured 3 hours after the typewriting by a Macbeth densitometer (Model RD-100R, product of Macbeth Corp., with use of a red filter). The larger the value, the better is the amenability to recording.

PRESS SMUDGE

The density of color smudge produced on the sheet by a press at a pressure of 60 kg/cm$^2$ was measured by the same means as above. The larger the value, the more susceptible is the sheet to press smudging.

FRICTION SMUDGE

A sheet of wood free paper was superposed on the coated surface of the record sheet, and the sheets were rubbed five times under a load of 300 g/cm$^2$. The color smudge formed on the record sheet was inspected with the unaided eye.

A: slight smudge.

B: marked smudge, unsuited to use.

INK TRANSFERABILITY

The coated surface of the record sheet was printed by an RI printing test machine ("RI TESTER," product of Akira Industry Co., Ltd.). The print on the coated surface was inspected with the unaided eye for the evaluation of the transferability of the ink.

O: good.

X: poor, unsuited to printing.

Table 1 shows that the self-contained type pressure sensitive record sheets of the single layer type have well-balanced improved properties in respect of color forming ability, prevention of color smudging and printability.

We claim:

1. A self-contained type pressure sensitive record sheet prepared by coating a substrate with a mixture of a color acceptor and microcapsules containing a color former in the form of a single layer and drying the resulting coating, the mixture containing 40 to 200 parts by weight, per 100 parts by weight of the microcapsules calculated as solids, of a pulp powder having a weight average fiber length (TAPPI standard T232, SU-68) of 20 to 80μ.

2. A self-contained type pressure sensitive record sheet as defined in claim 1 wherein the pulp powder is incorporated in an amount of 50 to 100 parts by weight per 100 parts by weight of the microcapsules calculated as solids.

* * * * *